United States Patent [19]

Harris

[11] 4,167,105

[45] Sep. 11, 1979

[54] TANDEM MILL DRIVE CONTROL SYSTEM

[75] Inventor: Thomas E. Harris, Pointe Claire, Canada

[73] Assignee: Dominion Engineering Works Limited, Canada

[21] Appl. No.: 828,371

[22] Filed: Aug. 29, 1977

[30] Foreign Application Priority Data

Sep. 29, 1976 [CA] Canada ..... 262269

[51] Int. Cl.[2] ..... B21B 36/06

[52] U.S. Cl. ..... 72/19; 72/29

[58] Field of Search ..... 72/19, 21, 35, 8–10, 72/205, 9, 12, 29; 73/234, 143

[56] References Cited

U.S. PATENT DOCUMENTS

| | | | |
|---|---|---|---|
| 1,109,885 | 9/1914 | Webster | 72/21 |
| 2,650,495 | 9/1953 | Norton | 72/234 X |
| 3,214,970 | 11/1965 | Flinth | 73/143 |
| 3,290,912 | 12/1966 | Reid | 72/12 X |
| 3,310,971 | 3/1967 | Motomatsu et al. | 72/21 |
| 3,964,282 | 6/1976 | Stubbs et al. | 72/19 |

*Primary Examiner*—Milton S. Mehr

*Attorney, Agent, or Firm*—Daniel Patch; Kikel Suzanne

[57] ABSTRACT

A rolling mill section for rolling or roughing slab, plate, billet or structural section is provided with a load sensing arrangement for determining if the extent of non-synchronization between the respective drive motors of the rougher stand and the edger stand is sufficient to cause significant tensile or compressive loading in the member being rolled, as it passes between the two stands. The existence of such loading is determined by providing a coupling or utilizing existing mechanical connection of the one or both structures of the stands, and measuring reactive forces generated thereat by the passage of the member being rolled, tending to displace one stand relative to the other. A readout from the force measuring means is used to control the relative torques of the respective stand motors so as to promote synchronicity of the two drives, in order to reduce damaging overloads in the edger or in the rougher which otherwise result when significant lack of synchronicity is present.

The invention is directed to a rolling mill and in particular to a mill section containing a rougher stand and an edger stand in adjacent relation, as in a steel mill, wherein the member being rolled is of sufficient length and stiffness to transfer significant loads between the stands, and to a method of operating the section.

7 Claims, 4 Drawing Figures

TANDEM MILL DRIVE CONTROL SYSTEM

In the operation of rolling mills, such as steel mills wherein a roughing stand and an edger stand are arranged in adjacent relation, difficulty is experienced in satisfactorily synchronizing the speed of the respective drive motors of the two stands. The problem is of sufficient magnitude that under "upstream rolling" conditions of serious drive mismatch, with the workpiece moving from rougher to edger, with the roughing stand running faster than the edger stand there is generated a compressive force in the workpiece between the two stands, tending to push the workpiece through the edger rolls and to overdrive the edger motor.

In the case when the edger mill is driven too fast, with the workpiece passing from rougher to edger there is a tendency to place the workpiece in tension, and to draw it through the rougher mill. Owing to the great difference in power and loads acting on the two mill stands, the power of the edger is insufficient to effectively speed-up the rougher stand, so that the power consumption of the edger becomes wastefully excessive. Also, the mill stand components suffer undue stress and wear, particularly in the case of the edger stand drive gear train, which usually includes helical and spiral bevel gears.

In the case of rolling "downstream", from edger to rougher, if the edger is energized for running at a higher speed than the rougher, the mismatch can place the workpiece in compression, causing the edger motor to take on much greater load than it would do in "synchronized" operation.

In addition to producing adverse effects on the mill drive motors, there is also a tendency to deform the workpiece, while the life of the rolls, particularly the edger rolls and the life of the edger drive gears and other parts is adversely affected.

Previous work done in correlating the operation of a plurality of mill stands include Canadian Pat. No. 832,170, K. A. Yeomans, Jan. 13, 1970, and Pat. No. 810,908, G. H. Samuel et al, Apr. 22, 1969. Both of these prior art arrangements rely upon complex monitoring arrangements usually used in combination with a control computer.

The presently disclosed arrangement has the advantages of simplicity, robustness, relative low cost and fail-safe characteristics, while being suitable for use in adapting existing installations.

It is suggested, by monitoring variations in the reactive or stabilizing forces acting on one of the stands, which result from the variations of longitudinal loading transferred through the workpiece, that an output control signal can be obtained for suitably moderating the drive of one of the stands in the necessary load increase or load decrease sense to more nearly synchronize the two stands and thereby effectively diminsh the transferred workpiece force. There are a number of ways of monitoring variations in stand forces. This can be effected directly by utilizing an existing connection between the two stands or providing such an interconnecting linkage, and monitoring variations in the forces acting on such connection or linkage. Alternatively, by strain gauging the footing attachments of one of the stands to its base, a measure of the load variations is obtained, suitable for amplification to control the drive of one or other of the stands. Alternatively, other portions of the stand structure may be monitored to detect stresses in the stand structure due to the thrust or tensile load at the stand pass line applied by the workpiece. This force, acting at the pass line evidently applies an overturning moment to the respective stands which may be suitably monitored and utilized.

It will be understood that such force variation monitoring arrangements provide inherent closed servo loops, as the variation effected on one of the mill stand drives as a consequence of a detected stand integer change causes a change in the force acting upon the workpiece, thus resulting in an appropriate reduction in the detected stand integer.

Control of the drive of the respective motors to diminish this longitudinal out of balance force, while driving the motors more economically, also reduces the stress loads acting longitudinally on the billet or workpiece.

One relatively simple and practical manner of protecting the arrangement is to couple the edger stand to the rougher stand. A load-cell placed between the connecting members securing the two stands together, can then provide a read-out proportional to the force transferred by the billet tending to displace one stand relative to the other. This force read-out signal can then be applied in a controlling corrective sense to increase or decrease one or other of the mill drives, so as to reduce the stand displacement force to a more acceptable value.

The present invention thus provides a method of operating a rougher-edger mill combination having a roll stand for face-rolling an elongated workpiece and an edger stand for edge-rolling the workpiece in selected sequential relation, including the steps of securing load sensing means to a stress sensitive portion of the combination, obtaining a read-out responsive to variations in force transferred from one stand to the other stand by the workpiece on passage therebetween, and controlling the drive to one stand in response to the force variations, whereby the transfer force is diminished. It is considered generally preferable to effect drive correction in the edger stand, because of the lower powers involved.

It will be understood that reference made herein to driving the mill stand motors to achieve synchronicity is really allusive. It is quite evident that the rolls, generally speaking, are bound to operate in substantial synchronism with the workpiece. However, if one of the motors such as the edger motor is either under-powered or overpowered, then the energy losses in the motor and also in the transmission line are both uneconomic and often destructive.

In an arrangement having a compressive load cell inserted between connecting members extending between the stands, the load cell being mechanically precompressed by an extent greater than the pulling power of the edger mill, the load cell read-out will vary up or down from its pre-set value, but may not normally reach a zero value.

Thus in a typical mill installation, utilizing a load cell capable of containing a 500,000 pound compressive load, and by mechanically precompressing the coupling members and the load cell to a value such as 150,000 pounds, then the edger mill can exert a tensile load on the billet of up to 150,000 pounds, to reduce the load cell reading to zero.

Certain embodiments are described, reference being made to the accompanying drawings wherein.

Figure 1:
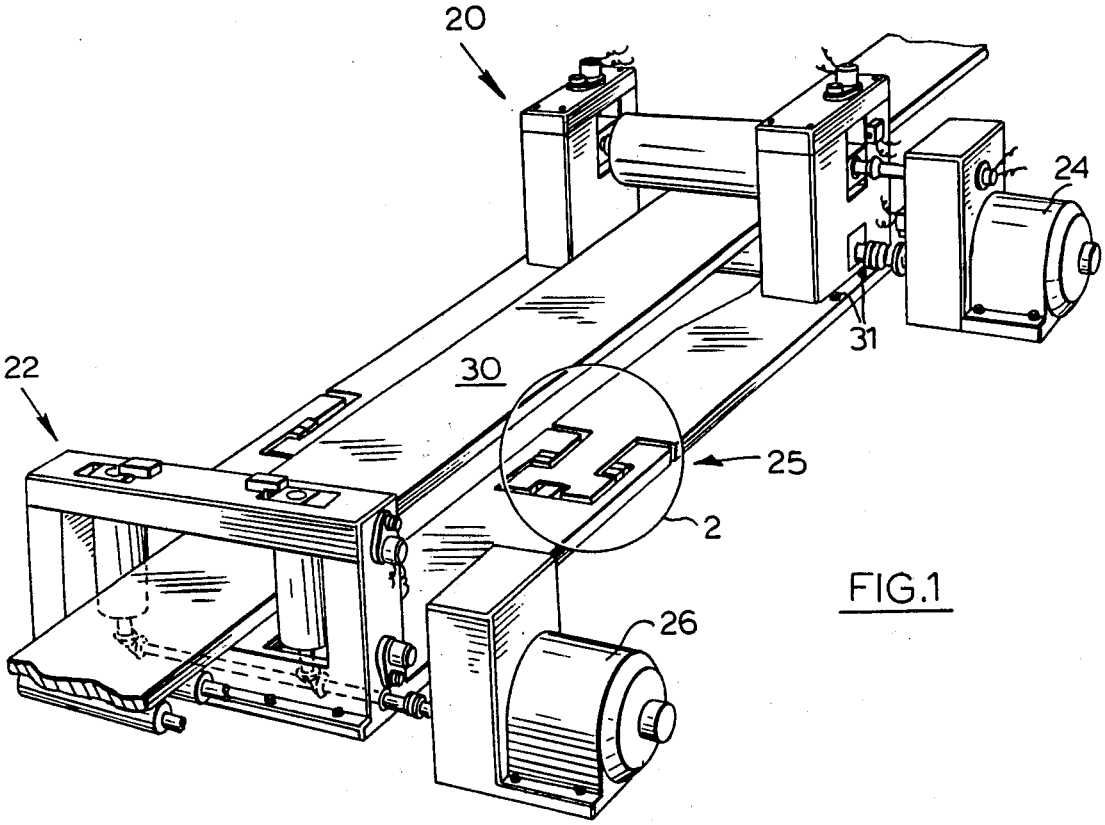
FIG. 1 is a general view of an installation embodying the present arrangement.

Referring to FIG. 1, a rougher stand 20 and an edger stand 22 in adjoining relation are connected by interconnecting restraining means 25. The interval between the stands has been grossly exaggerated to facilitate illustration. The rougher stand 20 is driven by an electric motor 24 and the edger stand 22 is driven by an electric motor 26. The stand 20 is secured on a sole plate, not shown, by way of hold down bolts 31, whereas the edger stand 22 is illustrated as being relatively free to move under the action of the workpiece, billet 30 and the restraining means 25. In fact it would normally be possible to secure the edger stand at its base, the load cell motion being very small.

Figure 2:
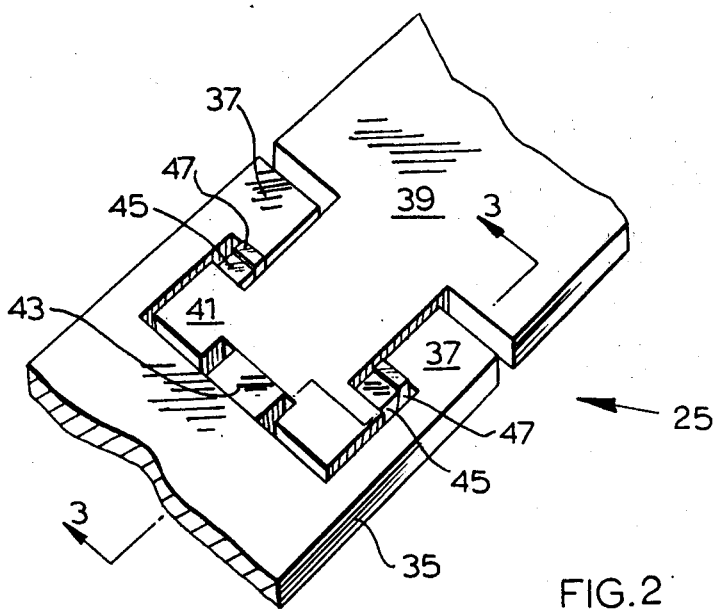
FIG. 2 is an enlarged view of the portion 2 of FIG. 1.
Figure 3:
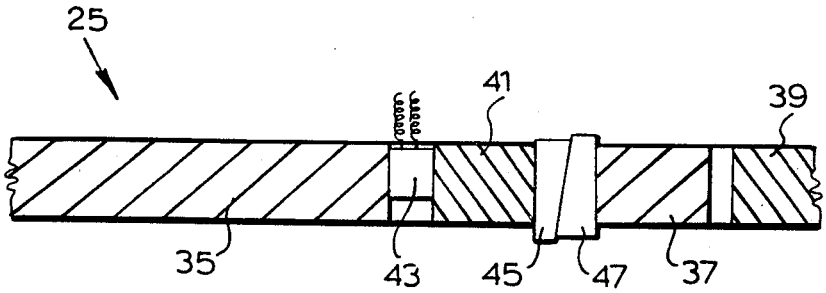
FIG. 3 is a section at 3—3 of FIG. 2.

Referring also to FIGS. 2 and 3, the restraining means 25 comprises a restraining plate 35 having end portions 37 forming an open pocket. A gib-plate 39 has an enlarged head portion 41 located within the open pocket.

A suitable compression load cell 43 is compressed between the head portion 41 and the plate 35 by way of tapered wedges 45, 47 inserted between the head portion 41 and the end portions 37 which semi-enclose the open pocket, to provide a predetermined value of precompression to the cell 43.

Figure 4:
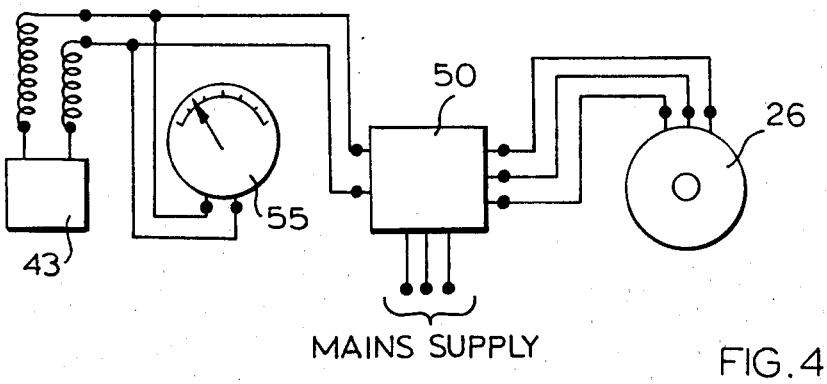
FIG. 4 is a schematic circuit diagram of a motor control circuit.

Referring to FIG. 4, the load cell 43 has an output therefrom connected to a motor controller 50, illustrated as being connected in controlling relation with the motor 26 of the edger mill 22. A voltmeter 55 is shown having as an indication the initial load applied by the wedges 45, 47 in pre-compressing relation to the load cell 43. This is shown primarily to illustrate the purpose of applying a pre-compressive load in excess of the tensile load which may be applied to the billet by the edger 22.

Considering the extreme case wherein lack of synchronization is such that the full power of the edger 22 is pushing the billet 30 toward the rougher stand 20, thereby tending to place the restraining means 25 under tension. The compressive load acting on the load cell will diminish until it reaches a minimum value equal to the difference between the precompressive load and the load applied by the edger. This value is selected to always have a positive value, so that a compression type load cell 43 will suffice for all load conditions. Alternative arrangements are contemplated.

It will be seen that the load-cell responsive control system is a closed loop, as the billet force provides a feed back through the motor 26 and the edging rolls to the load cell.

In view of the considerable overload capability of the two stands the force-responsive control is generally arranged to operate at predetermined values of overload. In addition, the readout on the volt meter 55 gives a ready visual check on the state of the system.

It will be seen that the system is fail-safe, in that when the workpiece passes through one or other of the stands so that little or no force is transmitted therethrough, the signal output from load cell 43 will return to a value corresponding approximately to the precompressive load, and the rate of the edger mill will adjust accordingly.

It will be understood that the present invention is susceptible of use in the manner illustrated as a built-in mill installation, or as an adaptive kit, and may be used with a rougher stand operating in combination with an exit-side located edger and/or an entry-side located edger.

The presently disclosed embodiment is directed to a linkage arrangement between the edger stand and the rougher stand wherein the total force transmitted by the workpiece between the the two stands is transmitted through a connecting linkage, and the total force monitored by use of an appropriate load cell. However, it will be appreciated that by judicious use of strain gauges on existing or supplemental stand members a stress reading proportional to the workpiece load can be obtained, and utilized in a manner equivalent to that disclosed herein to control the drive power applied to at least one of the stand motors, so as to effectively diminish the force transmitted between stands by the workpiece.

In accordance with the patent statutes, I have explained the principles and operation of my invention, and have illustrated and described what I consider to represent the best embodiment thereof.

I claim:

1. In a rolling mill having a first roll stand and a second roll stand positioned adjacent thereto along the path of a workpiece to receive in operation a substantially rigid workpiece, the improvements comprising:

force linkage means connected between said first and said second stands extending generally parallel with and spaced from said pass line, load measuring sensor means arranged with said linkage means to be responsive to changes in loads transferred by said workpiece, the relationship of said workpiece, said first and said second stands, said linkage means and said second means being such as to form a rigid force transmitting network between said workpiece and said sensor means, in which said linkage means, said first and said second stands, and said sensor means are immobile with respect to each other, said sensor means having as output an electrical signal, signal transmitting conductor means connecting said sensor output to motor control means, said motor control means controlling the loading of at least one motor driving one said stand being responsive to said control signal to vary said motor loading relative to the motor loading of other said stand in the sense as to diminish said load transferred by said workpiece.

2. The apparatus as claimed in claim 1 wherein said sensor means comprises a transducer for attachment between said roll stands, in deformation sensing relation therewith.

3. The combination as claimed in claim 1 wherein one said stand is a roughing stand, and the other said stand is an edger stand.

4. The combination as claimed in claim 3, said sensor means comprising a load cell connected between said stands.

5. In combination as claimed in claim 4 wherein said load cell is a compression load cell; including preloading means for applying a desired pre-load to said cell under no-load conditions.

6. A method of operating a rougher-edger mill combination having a rougher stand for face rolling a substantially rigid workpiece and an edger stand for edge rolling said workpiece along the pass line between work rolls of said rougher and edger stands including the steps of:

causing a force linkage means to be connected between said rougher stand and edger stand and generally parallel with and spaced from said pass line, causing load sensor means to be responsive to changes in load transferred by the workpiece, establishing a relationship between said workpiece, rougher and edger stands, linkage means and sensor means to form a rigid force transmitting network between said workpiece and said sensor means and causing said linkage means, first and second stands, and sensor means to be immobile with respect to each other, obtaining an electrical signal readout from said sensor means, and controlling the loading of at least one motor driving one said stand from said control signal to vary said motor loading relative to the motor loading of the outer stand in the sense so as to diminish said load transferred by said workpiece.

7. The method as claimed in claim 6, wherein said one stand comprises said edger stand.

* * * * *

UNITED STATES PATENT AND TRADEMARK OFFICE

CERTIFICATE OF CORRECTION

PATENT NO. : 4,167,105
DATED : September 11, 1979
INVENTOR(S) : Thomas E. Harris It is certified that error appears in the above-identified patent and that said Letters Patent are hereby corrected as shown below:

Column 4, Claim 1, lines 37 and 38 "said second means" should read --said sensor means--

Signed and Sealed this

*Fourth* Day of *March 1980*

[SEAL]

*Attest:*

SIDNEY A. DIAMOND

*Attesting Officer*

*Commissioner of Patents and Trademarks*